US005921440A

United States Patent [19]

Maines

[11] Patent Number: 5,921,440

[45] Date of Patent: Jul. 13, 1999

[54] MULTI-COMPARTMENT CONTAINER AND ADJUSTABLE DISPENSER

[76] Inventor: Morris P. Maines, 11301 Pursiane Ct., Charlotte, N.C. 28213

[21] Appl. No.: 08/922,509

[22] Filed: Sep. 3, 1997

Related U.S. Application Data

[51] Int. Cl.[6] ..... B67D 5/60

[52] U.S. Cl. ..... 222/145.2; 222/94; 222/129; 222/144.5; 220/253; 220/525; 215/6

[58] Field of Search ..... 222/129, 94, 144.5, 222/145.2; 220/253, 525; 215/6

[56] References Cited

U.S. PATENT DOCUMENTS

| | | | |
|---|---|---|---|
| 2,681,745 | 6/1954 | Henry Sung et al. | 222/144.5 |
| 3,876,112 | 4/1975 | Kramer | 222/144.5 |
| 5,779,102 | 7/1998 | Smith | 222/144.5 |
| 5,794,819 | 8/1998 | Smith | 222/129 |

*Primary Examiner*—David J. Walczak
*Assistant Examiner*—Timothy L. Maust
*Attorney, Agent, or Firm*—Clifton Ted Hunt

[57] ABSTRACT

The multi-compartment container is made from previously formed partial bottles and is preferably made from two "half-bottles" that are individually formed from a pliable plastic with a semicircular wall on one side and a flat wall on the other side, as by blow molding. The two half-bottles are joined together with the flat walls in juxtaposition to define the body portion of the multi-compartment container, with each "half-bottle" serving as one of its compartments or chambers. A cap with a dispenser for each compartment serves as a cover for the container. The pliable plastic from which the container is formed enables a person to squeeze either of the compartments to dispense from one of the compartments or squeeze both compartments to dispense from both compartments. One embodiment of the invention includes a dial-a-matic selection system adapted, but not restricted, to the dispensing of mustard and catsup.

5 Claims, 6 Drawing Sheets

MULTI-COMPARTMENT CONTAINER AND ADJUSTABLE DISPENSER

FIELD OF THE INVENTION

This invention relates to multi-compartment containers and, more specifically, to a multi-compartment container and adjustable dispenser for viscous liquids, such as catsup and mustard or shampoo and conditioner.

BACKGROUND OF THE INVENTION

Multi-compartment containers for liquids are known in the art. See, for example, the following patents:

U.S. Pat. No. 5,398,827 issued Mar. 21, 1995 to Armstrong et al. for MULTI-VESSELLED BEVERAGE CONTAINER.

U.S. Pat. No. 5,398,828 issued Mar. 21, 1995 to Valyi for BLOW MOLDED PLASTIC CONTAINERS INCLUDING INTERNAL SUPPORT AND HANDGRIP.

U.S. Pat. No. 5,588,550 issued Dec. 31, 1996 to Meyer for COMPARTMENTED CONTAINER INCLUDING CLOSURE WITH ACCESS TO INDIVIDUAL COMPARTMENTS.

U.S. Pat. No. 5,593,052 issued Jan. 14, 1997 to McGee for BABY BOTTLE WITH TWO SEPARATE FLUID CHAMBERS.

U.S. Pat. No. 5,607,072 issued Mar. 4, 1997 to Rigney et al. for BEVERAGE CONTAINERS.

Each of these prior art patents discloses a multi-compartment container that is made from plastic or glass and is particularly adapted to contain beverages or other conventional liquids with low viscosity.

Meyer discloses a rotatable cover 54 extending across four compartments for the storage of liquids under pressure, such as carbonated beverages. The cover has an opening and the cover can be manually rotated to register the opening with either one or two selected compartments to dispense the contents while maintaining the pressure on the carbonated beverages in the remaining compartments.

None of the prior art known to applicant discloses a multi-compartment container in the form of a pliable plastic bottle adapted to contain and selectively dispense relatively viscous liquids, such as catsup and mustard, for example.

SUMMARY OF THE INVENTION

This invention relates to a multi-compartment container for viscous liquids and to an adjustable ("dial-a-matic") dispenser for dispensing from either one or more compartments.

Although the multi-compartment container of this invention has many uses, for purposes of illustration, the invention will be described as a multi-compartment container for mustard and catsup.

The multi-compartment container of this invention is made from previously formed "partial bottles" and is preferably made from two previously formed "half-bottles". The initial step in the invention is to individually form each of the "half-bottles" from a pliable plastic, as by blow molding, each "half-bottle" comprising a flat side wall opposed by a semi-circular side wall, a bottom wall and a threaded portion opposite the bottom wall.

The flat walls and corresponding edges of two "half-bottles" are bonded together to define the body portion of the multi-compartment container of this invention. Each "half-bottle" and the space therein serves as one of the compartments in the multi-compartment container. A cap with a dispenser for each compartment serves as a cover for the multi-compartment container.

The pliable plastic from which the multi-compartment container is formed enables a person to squeeze either of the compartments and push out one of the condiments or squeeze both compartments and squeeze out both is mustard and catsup simultaneously on foods like hot dogs and sandwiches.

Hot dogs, hamburgers and french fries are eaten by millions of people every day. The multi-compartment container of this invention provides an economical container for catsup and mustard and the dial-a-matic dispenser makes the condiments easily and readily accessible.

Although only two preferred embodiments of the invention are being described, each of which discloses a multi-compartment container with two compartments, it is to be understood that it is within the spirit and scope of the invention for the container to have more than two compartments.

Each embodiment disclosed herein comprises a multi-compartment container defined by two half-bottles, and a cap for the container with a dispenser for each compartment.

The second embodiment also includes an adjustable ("dial-a-matic") selection system that is easily adjustable to dispense from either or both of the compartments and to seal the compartments to maintain the freshness of the contents.

DETAILED DESCRIPTION OF THE EMBODIMENT

The First Embodiment

Figure 1:
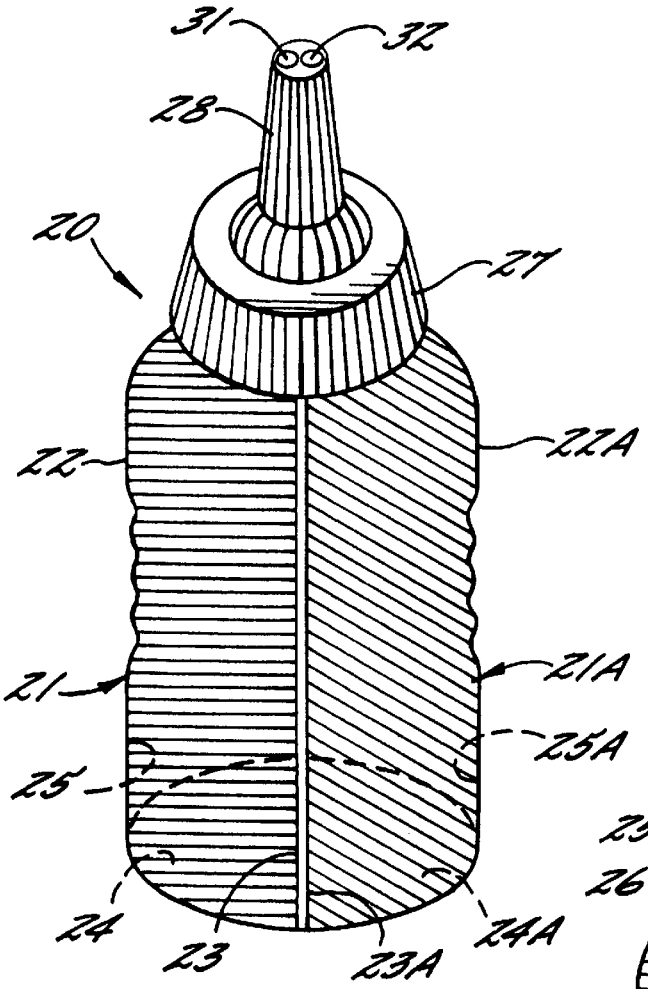
FIG. 1 is a perspective view of a first embodiment of the invention, showing a multi-compartment container (bottle) defined by two half-bottles and its removable dispenser-cap, the horizontally lined portion representing mustard (for example) in one compartment and the angularly lined portion representing catsup (for example) in the other compartment.
Figure 2:
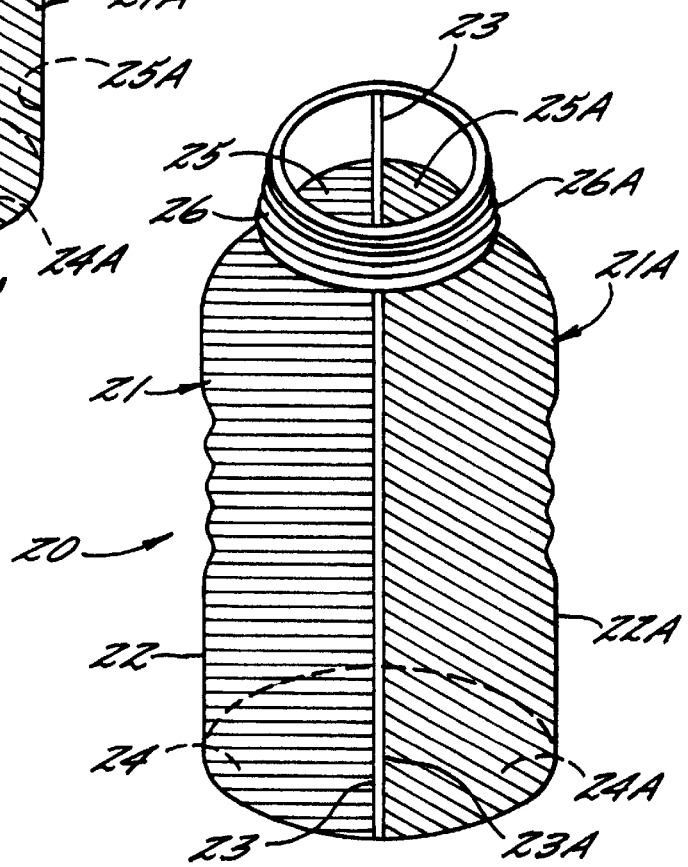
FIG. 2 is a perspective view of the bottle shown in FIG. 1, without the dispenser-cap.

FIGS. 1–4 illustrate the first embodiment of the invention, wherein the body portion of a multi-compartment container 20 is formed from two half-bottles 21 and 21A. The half-bottles 21 and 21A are identical and a description of half-bottle 21 will suffice for an understanding of half-bottle 21A, wherein like parts bear the same reference character with the letter "A" added.

Half-bottle 21 comprises a semi-circular wall 22 formed integrally with a flat wall 23 and a bottom wall 24 to define a chamber or compartment 25 with 11 a threaded portion 26 opposite the flat wall 23. Each half-bottle is preferably formed, as by blow-molding, from a plastic which is pliable. The multi-compartment bottle 20 is formed by bonding together the flat walls and corresponding edges of two half-bottles, with the threaded portions on the two half-bottles complementing each other.

Figure 3:
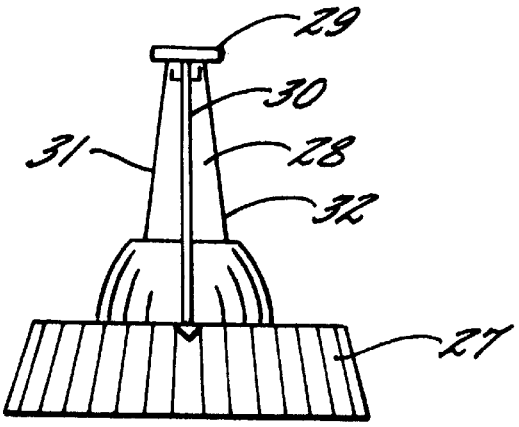
FIG. 3 is a side view of the dispenser-cap shown in FIG. 1, removed from the bottle.
Figure 4:
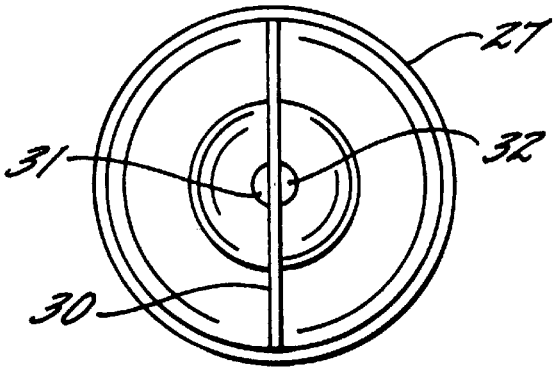
FIG. 4 is a bottom view of the dispenser-cap shown in FIG. 3.
Figure 5:
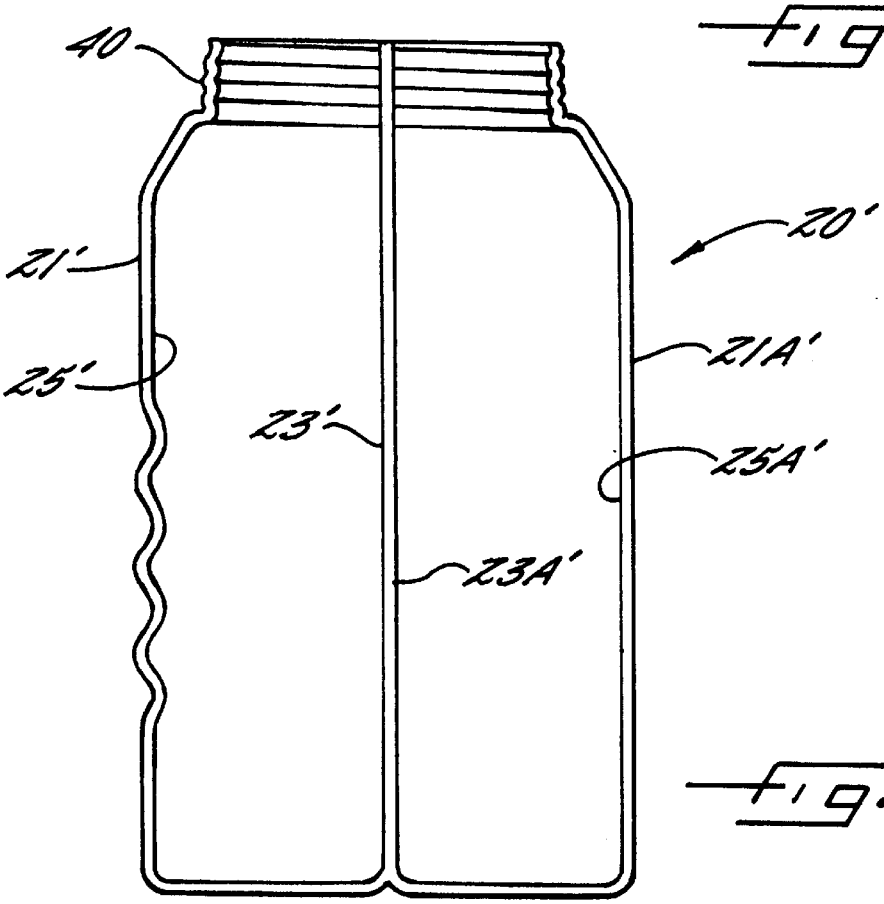
FIG. 5 is a side view of the bottle shown in FIG. 2, which serves as the multi-compartment container or bottle for a second embodiment of the invention.

The top of the bottle 20 is threadably closed by a dispenser-cap 27 formed from a rigid plastic and terminating in a spout 28. A partition 30 divides the spout 28 into two passageways 31 and 32 (FIGS. 3 and 4). When the cap 27 and bottle 20 are operatively assembled, the partition 30 in the spout 28 is in alignment with the partition 23 in the bottle 20 (FIG. 2) The partition 23 is defined by the bonded flat walls 23 and 23A.

The passageway 31 communicates with compartment 25 in half-bottle 21, and passageway 32 communicates with compartment 25A in half-bottle 21A With mustard in the compartment 25 and catsup in the compartment 25A, a user can dispense both condiments simultaneously by directing the spout toward a hot dog, for example, and applying hand pressure against the semi-circular side walls 22 and 22A of bottle 20.

The contents of either compartment can be dispensed from bottle 20 by increasing the pressure on either side wall 22 or side wall 22A while lessening pressure on the other side wall. Alternatively, either of the condiments can be dispensed by applying hand pressure to the bottle 20 and placing a flexible tab 29 (FIG. 3) over the outlet of either the passageway 31 or the passageway 32 is to block the flow from either compartment.

The Second Embodiment

The second embodiment of the invention, illustrated in FIGS. 5–14, comprises a multi-compartment container 20$^1$ like the multi-compartment container 20 in the first embodiment of the invention. Like parts in the second embodiment bear the same reference numbers as those parts in the first embodiment, with the prime notation added.

In the second embodiment, the threaded portions 26$^1$ and 26A$^1$ combine to define a threaded portion 40 that supports an adjustable (dial-a-matic) selection system as best seen in FIGS. 7 and 11–14.

Figure 7:
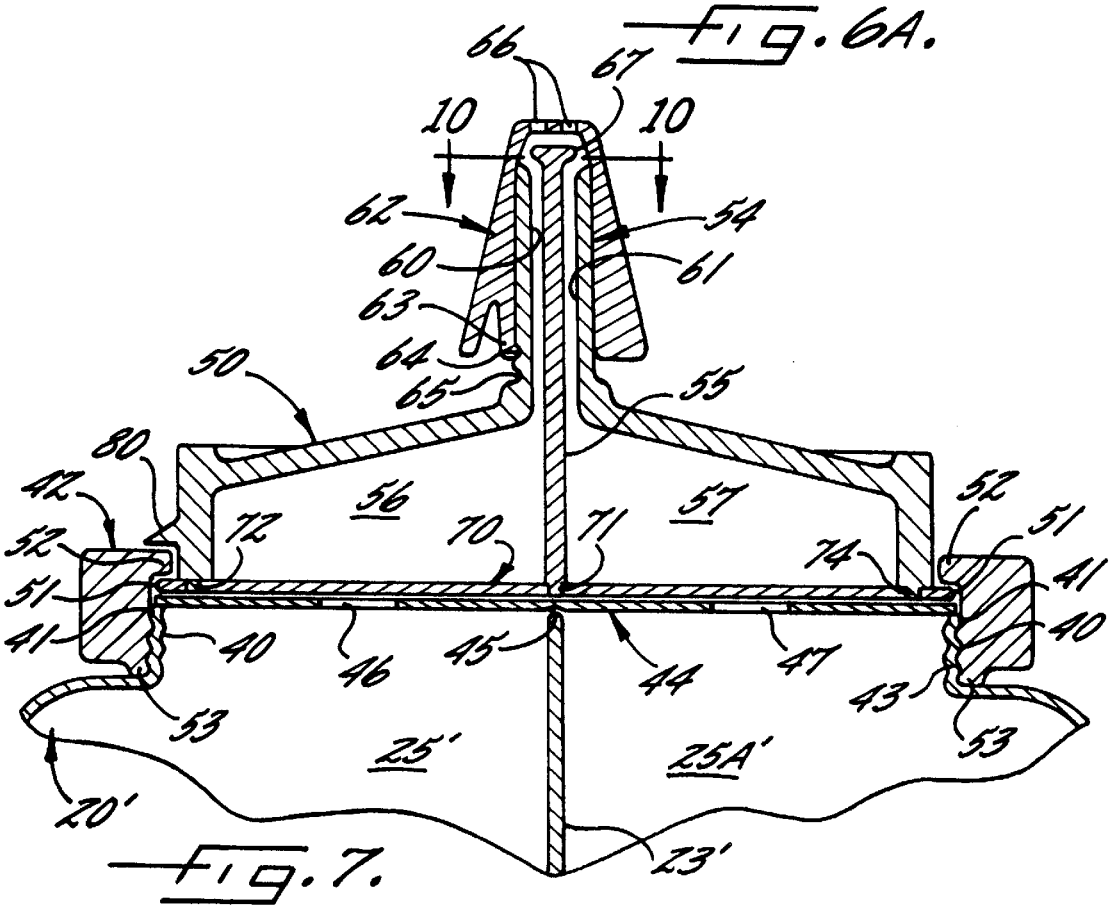
FIG. 7 is a sectional view, with parts broken away, showing the cap and dial-a-matic selection system operably mounted on the bottle of FIG. 5.
Figure 8:
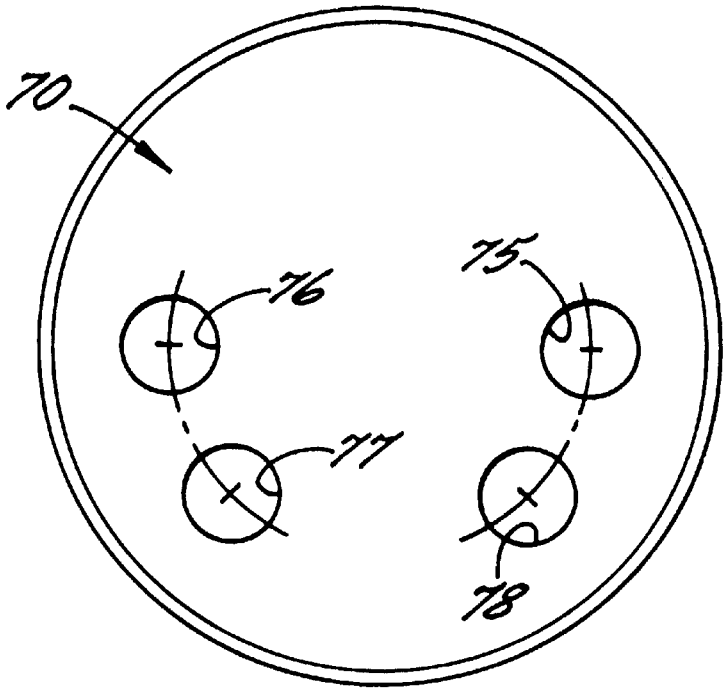
FIG. 8 is an enlarged top view of a second disk that functions as a part of the dial-a-matic selection system and is mounted for rotation with the cap shown in FIG. 7.
Figure 9:
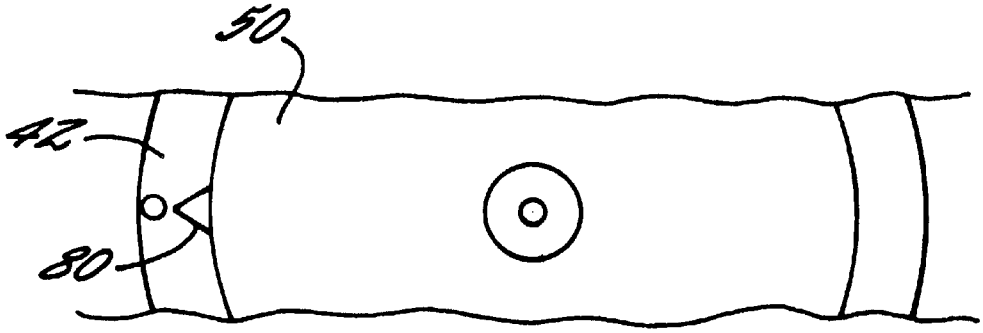
FIG. 9 is a fragmentary top view, with parts broken away, of the cap and selection system shown in FIG. 7.
Figure 10:
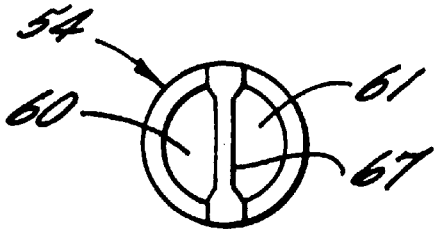
FIG. 10 is a sectional view taken substantially along the line 10—10 in FIG. 7.

Referring to FIG. 7, the dial-a-matic selection system includes a threaded retaining collar 42 which is dimensioned for threadable attachment to the threaded portion 40.

Figure 6:
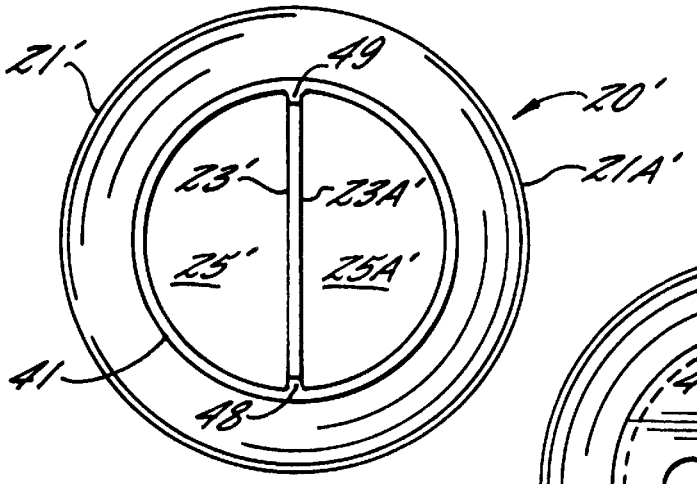
FIG. 6 is a top view of the bottle shown in FIG. 5.
Figure 6A:
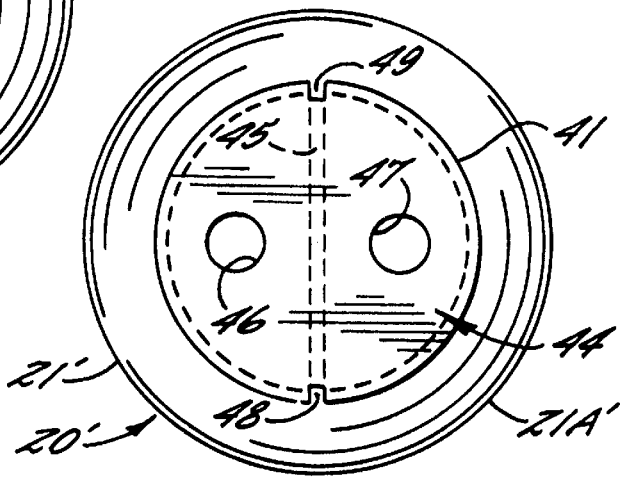
FIG. 6A is a view like FIG. 6, showing the top of a disk that removably covers the top of the bottle but is fixed against rotation and functions as a part of the dial-a-matic selection system.

A first plastic disk 44 (FIG. 6A and 7) is removably supported on the upper edge 41 of the threaded portion 40 of container 20$^1$. The disk 44 has holes 46 and 47 therethrough that provide communication with the contents of the chambers 25$^1$ and 25A$^1$, respectively. The holes 46 and 47 are on opposite sides of a groove 45 that extends across the inner surface of the disk 44 for registry with the partition 23 (bonded flat walls 23$^1$, 23A$^1$) in the bottle 20$^1$ when the disk 44 is operably positioned on top of the bottle 20$^1$. The disk 44 is held in operative position by engagement of the groove 45 with opposed notches 48 and 49 in the upper edge 41 of the threaded portion 40 (FIGS. 6 and 6A).

A circular cap 50 is rotatably retained over the container 20$^1$ by the retaining collar 42. An outwardly directed flange 51 extends around the circumference of the cap 50 and beneath an inwardly directed flange 52 extending circumferentially around the retaining collar 42 (FIG. 7). An annular abutment 53 extends downwardly from the retaining collar for engagement with the bottle 20$^1$ when the retaining collar is fully seated on the threaded portion 40.

A nozzle 54 extends upwardly in FIG. 7 from the cap 50. A partition 55 extends through the cap 50 and into the nozzle 54. The portion of the partition 55 that is in the cap 50 divides the cap into two chambers, 56 and 57. The portion of the partition 55 that is in the nozzle 54 defines a passageway 60 on one side of the partition 55 and a passageway 61 on the other side of the partition 55. The passageway 60 provides communication between the chamber 56 in the cap 50 and the ambient atmosphere at the end of the nozzle, while the passageway 61 provides communication between the chamber 57 in the cap 50 and the ambient atmosphere.

The free end or top of the nozzle 54 is covered by a closure 62 having a frusto-conical configuration. A resilient snap finger 63 extends downwardly and inwardly from the closure 62 for engagement with either of two vertically spaced notches 64 and 65 at the base of the nozzle 54. The closure 62 has two openings 66 in its top wall positioned directly above the partition 55 that extends into the nozzle 54. When the snap finger 63 is in the lower notch 65, the closure is lowered sufficiently for the opening 66 to be closed by a transverse plug 67 on top of the partition 55. When the snap finger 63 is in the upper notch 64, the closure is raised sufficiently to unplug the openings 66 for discharge of the contents of compartments 25$^1$ and 25A$^1$.

A selection (dial-a-matic) disk 70 is fixed for rotation with the cap 50 as by molded pins 71, 72 and 74 that extend downwardly from the cap in FIG. 7 and plastic weld the disk 70 to the cap 50. The engagement of the abutment 53 with the bottle 20$^1$ maintains sufficient space beneath the flange 52 for the cap 50 and disk 70 to remain easily rotatable relative to the disk 44 after the cap 50 is operably connected to the threaded portion 40 by the retaining collar 42.

Four holes 75, 76, 77 and 78 are positioned in the disk 70 in such a manner that by manually rotating the cap 50 and the attached disk 70, one or more of the holes 75–78 is selectively registrable with each, both, or neither of the holes 46 and 47 in the disk 44. This arrangement provides a dial-a-matic selection system that operates as shown in FIGS. 11–14.

Figure 11:
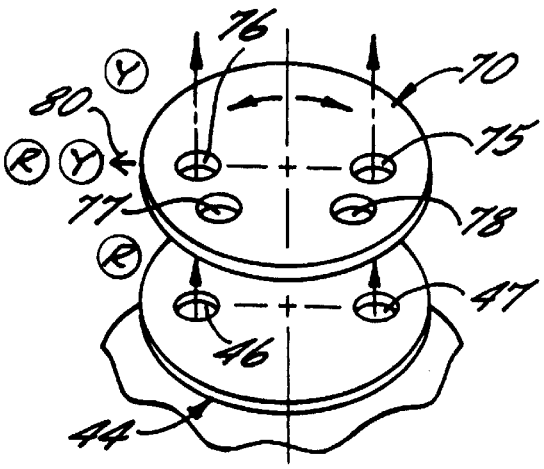
FIGS. 11–14 are fragmentary exploded perspective views illustrating the operation of the dial-a-matic selection system.

As shown in FIG. 11, when hole 75 in disk 70 is aligned with hole 47 in the disk 44 the hole 76 in disk 70 is also aligned with hole 46 in disk 44 and holes 77 and 78 in disk 70 are closed by the disk 44. With the closure 62 on the nozzle 54 elevated to the open position, hand pressure on the bottle $20^1$ will force contents from both of the compartments $25^1$ and $25A^1$ through the 11 aligned holes 75/47 and 76/46 and through respective chambers 57 and 56 in the cap 50 and out of the nozzle 54.

Thus, if, for example, there is mustard in compartment $25^1$ and catsup in compartment $25A^1$, both mustard and catsup can be applied to a hot dog at the same time.

Figure 13:
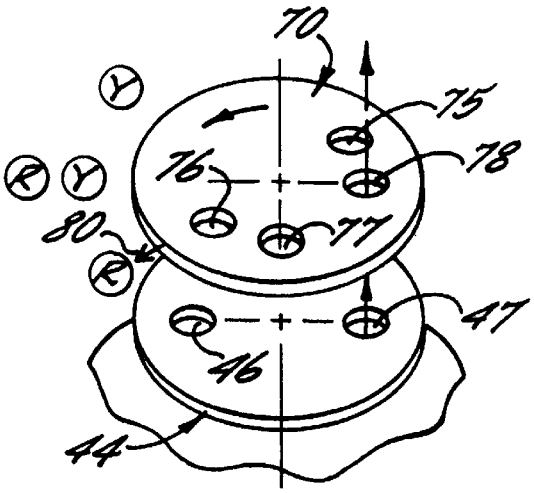
Figure 12:
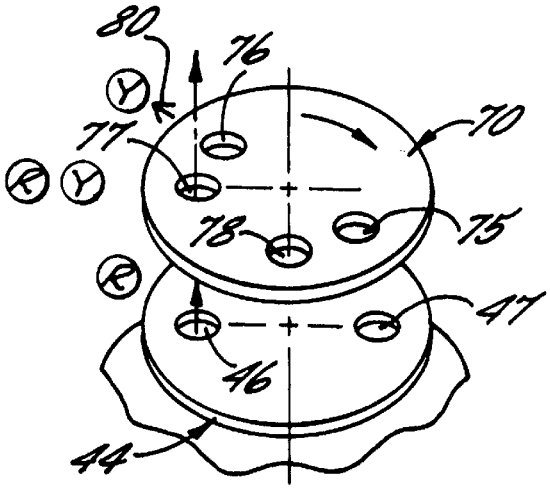

FIG. 12 shows that the disk 70 can be rotated relative to the disk 44 to align hole 77 in disk 70 with hole 46 in the disk 44 while the other three holes in disk 70 (holes 76, 78 and 79) are closed by the disk 44. This alignment would allow only mustard, for example, to be dispensed from the bottle $20^1$ FIG. 13 shows that the disk 70 can be rotated relative to the disk 44 to align hole 78 in disk 70 with hole 47 in the disk 44 while the other three holes in disk 70 (holes 76, 77 and 79) are closed by the disk 44. This alignment would allow only catsup, for example, to be dispensed from the bottle $20^1$.

Figure 14:
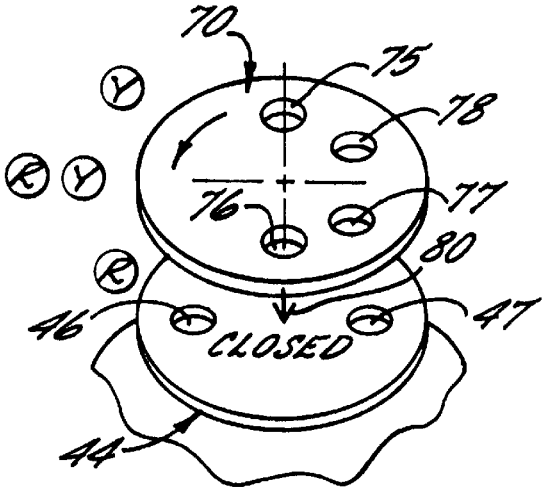
Figure 15:
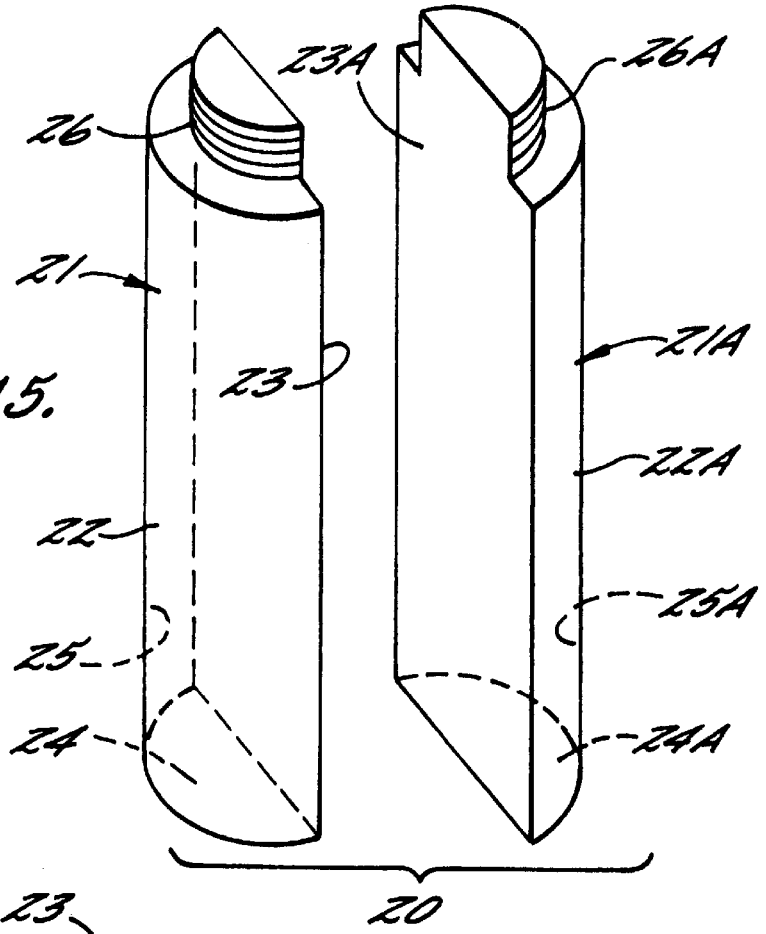
FIG. 15 is a perspective view showing two of the previously formed it half-bottles that are bonded together according to the invention, shown as having been made from transparent plastic for illustrative purposes.
Figure 16:
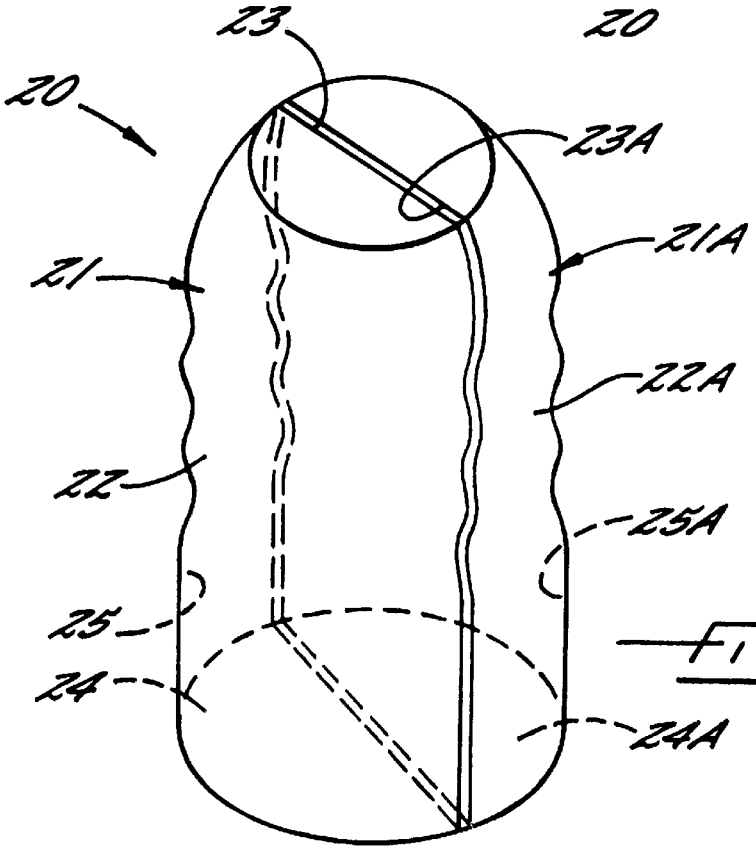
FIG. 16 is an illustrative perspective view, with parts broken away, of two half-bottles, shown as having been made from transparent plastic for illustrative purposes, and bonded together to form the multi-compartment bottle shown in FIGS. 2 and 5, the threaded portion of the bottle being omitted for clarity of the illustration.

FIG. 14 shows that the disk 70 can be rotated relative to the disk 44 to a position where all four of the holes in disk 70 (holes 76, 77, 78 and 79) are closed by the disk 44, thereby effectively sealing both of the compartments $25^1$ and $25A^1$ for preservation of their contents.

An indicator 80, in the nature of a small flange, extends radially from the cap 50 (FIG. 7). The indicator 80 follows an annular path around the retaining collar 42 when the cap 50 is rotated relative to the disk 44 to make a selection of the contents in compartments $25^1$ and $25A^1$. The retaining collar is marked with appropriate symbols or indicia to designate the position necessary to dispense a desired selection.

For example, in FIGS. 11–14, the indicator 80 is schematically illustrated in each of those figures by the arrow 80. The circled letter Y refers to "Yellow", the color of mustard and the circled letter R refers to "Red", the color of catsup. These colors would clearly appear if, for example, mustard and catsup were in separate compartments within a transparent bottle.

In FIG. 11, the indicator 80 points to the circled Y and R and thereby indicates that the cap 50 and disk 70 are in position to dispense both mustard and catsup. In FIG. 12, the indicator 80 points to the circled R, indicating that only catsup will be dispensed. In FIG. 13, the indicator 80 points to the circled Y, indicating that only mustard will be dispensed. In FIG. 14, the indicator 80 shows a closed position and nothing will be dispensed.

Conclusion

There is thus provided a novel and effective container for packaging and dispensing different products that are frequently used either at the same time or sequentially. The packaging of mustard and catsup in separate compartments within the same bottle has been described as an example of the utility of the invention, but it is recognized that there are other uses for the invention. The scope of the invention is defined by the following claims.

I claim:

1. A multi-compartment container comprising a plurality of previously formed partial bottles bonded together to define a multi-compartment container, wherein each previously formed partial bottle defines a compartment in the multi-compartment container, the multi-compartment container including a threaded portion and a dial-a-matic selection system on said threaded portion, and wherein the dial-a-matic selection system comprises a rotatable cap mounted on the threaded portion of the container, first and second disks, the first disk being mounted on top of the threaded portion and fixed against rotation with the rotatable cap, the first disk having a first hole therethrough in alignment with a first of the two chambers and a second hole therethrough in alignment with a second of the two chambers, means fixing the second disk to the rotatable cap for rotation with the rotatable cap, the second disk having holes therethrough that are movable into and out of alignment with the holes in the first disk in response to rotation of the rotatable cap, means for indicating when one or more of the holes in the second disk are aligned with one or both of the holes in the first disk, and means responsive to inward hand pressure on the container for dispensing contents from either or both of the chambers.

2. A multi-compartment container for different types of liquids that are packaged for dispensing by a user either individually or collectively as the user desires, said multi-compartment container comprising:

a separate chamber for containing each type of liquid;

a threaded portion communicating with each chamber;

a first disk mounted on top of the threaded portion and fixed against rotation;

the first disk having a hole therethrough for each chamber and the holes providing outlets for their respective chambers;

a second disk;

means mounting the second disk for rotation relative to the first disk;

the second disk having holes therethrough that are movable into and out of alignment with one or more of the holes in the first disk in response to rotation of the second disk;

means for indicating when one or more of the holes in the second disk are aligned with one or more of the holes in the first disk;

means for indicating which chamber or chambers are communicating with aligned holes in the first and second disks; and means for dispensing liquid from a single chamber that communicates with aligned holes in the first and second disks and means for simultaneously dispensing liquid from a plurality of chambers that communicate with aligned holes in the first and second disks.

3. The invention of claim 2 which includes a dispenser-cap formed from a rigid plastic and terminating in a spout.

4. The invention of claim 3 wherein the dispenser-cap is mounted on the threaded portion of the multi-compartment container.

5. A multi-compartment container comprising a plurality of previously formed partial bottles bonded together to define a multi-compartment container, wherein each previously formed partial bottle defines a compartment in the multi-compartment container, the multi-compartment container including a threaded portion, and a dial-a-matic selection system on said threaded portion.

* * * * *